US006676450B2

(12) United States Patent
Schroll

(10) Patent No.: US 6,676,450 B2
(45) Date of Patent: Jan. 13, 2004

(54) ELECTRICAL CONNECTOR HAVING CONTACTS ISOLATED BY SHIELDS

(75) Inventor: Neil Schroll, Mount Joy, PA (US)

(73) Assignee: Tyco Electronics Corporation, Middletown, PA (US)

( * ) Notice: Subject to any disclaimer, the term of this patent is extended or adjusted under 35 U.S.C. 154(b) by 245 days.

(21) Appl. No.: 09/865,123

(22) Filed: May 24, 2001

(65) Prior Publication Data

US 2002/0031945 A1 Mar. 14, 2002

Related U.S. Application Data

(60) Provisional application No. 60/206,558, filed on May 25, 2000.

(51) Int. Cl.[7] ..... H01R 13/648
(52) U.S. Cl. ..... 439/608
(58) Field of Search ..... 439/608, 108

(56) References Cited

U.S. PATENT DOCUMENTS

| | | | | |
|---|---|---|---|---|
| 3,587,028 A | 6/1971 | Uberbacher | ..... | 339/14 |
| 4,632,476 A | 12/1986 | Schell | ..... | 339/14 R |
| 4,846,727 A | 7/1989 | Glover et al. | ..... | 439/608 |
| 5,201,855 A | 4/1993 | Ikola | ..... | 439/608 |
| 5,518,422 A | 5/1996 | Zell et al. | ..... | 439/608 |
| 5,620,340 A | 4/1997 | Andrews | ..... | 439/608 |
| 5,882,227 A | 3/1999 | Neidich | ..... | 439/608 |

*Primary Examiner*—Neil Abrams
*Assistant Examiner*—Phuong K Dinh

(57) ABSTRACT

The present invention discloses an electrical connector assembly for transmitting high speed data and a method of transmitting high speed data using an electrical connector. The electrical connector includes a housing having a plurality of contacts arranged in contact rows and columns, first shield members and second shield members. The first shield members are disposed in the housing between the contact rows, and second shield members are disposed in the housing between the contact columns such that the second shield members engage the neighboring first shield members. The first and second shield members electrically shield each of the contacts from the neighboring contacts on at least two sides. Each of the first shield members is a single unit adapted to extend along at least two adjacent rows of contacts. Each of the second shield members are generally planar with two arms extending from opposing sides of a main body, where the arms are adapted to deflect in a plane of the main body and engage respective first shield members.

41 Claims, 6 Drawing Sheets

ELECTRICAL CONNECTOR HAVING CONTACTS ISOLATED BY SHIELDS

CROSS REFERENCE TO RELATED APPLICATIONS

This application is related to, and claims priority from, Provisional Application No. 60/206,558 filed May 25, 2000, titled "Electrical Connector Having Contacts Isolated by Shields", the complete subject matter of which is incorporated herein by reference in its entirety.

FIELD OF THE INVENTION

At least one embodiment relates to an electrical connector or connector assembly having a plurality of contacts arranged in a grid, and shields disposed among and between the contacts for minimizing electrical crosstalk in the connector.

BACKGROUND OF THE INVENTION

Plug-in circuit boards with electronic components thereon are widely used in the telecommunication and computer industries, among other industries. High speed data signals are conveyed to and from the circuit boards at a desired data rate using cables and connectors. The data signals are comprised of multiple frequency components, each frequency component of which is attenuated to a differing degree by the cables, connectors and circuit boards.

Such circuit boards require carefully designed transmission paths to minimize interference and preserve signal integrity. As switching speeds increase, minimizing interference and preserve signal integrity. As switching speeds increase, minimizing interference and preserving signal integrity becomes more critical. To address such concerns, high frequency (low inductance) connecters have been developed for use with such circuit boards.

Conventional high frequency connectors employ shielding to minimize interference and preserve signal integrity. Such shielding is arranged on the connectors to shield contacts on the connectors from neighboring contacts reducing or minimizing crosstalk, preserving signal integrity.

U.S. Pat. No. 4,846,727 discloses an electrical connector including an insulating housing have a plurality of electrical contacts arranged in a grid of horizontal rows and vertical columns. Electrically conductive plates are disposed between the columns and are adapted for connection with an electrical reference or ground, thereby providing shield elements between the columns of contacts. These shield elements serve to prevent electrical crosstalk between contacts in adjacent columns.

U.S. Pat. No. 5,620,340 discloses an electrical connector including contacts arranged in a grid, and shielding elements that have a non-planar shape. These shielding elements may have a square-wave, serpentine, or other meandering shape to substantially shield each of the contacts from all neighboring contacts, including neighboring contacts in the same column.

A need exists for an electrical connector with improved shielding. There is a further need for improved shielding between the contacts in an electrical connector wherein the contacts are arranged in a high-density grid and wherein the improved shielding reduces or minimizes electrical crosstalk, signal to noise ratio and jitter signal to noise ratio. It is an object of at least one embodiment of the present invention to meet the foregoing needs and other objectives, which will become apparent from the detailed description, drawings and claims presented hereafter.

SUMMARY OF THE INVENTION

In accordance with one embodiment of the present invention, an electrical connector or connector assembly has been developed with improved shielding that reduces or minimizes interference and electrical crosstalk, preserving signal integrity. The connector in accordance with at least one embodiment of the present invention employs first and second shield members to isolate each of the contacts from neighboring contacts. The connector holds a plurality of contacts arranged in rows and columns. First shield members are disposed in the housing between the contact rows, and second shield members are disposed in the housing between the contact columns.

In accordance with at least one embodiment of the present invention, the first and second shield members electrically shield each of the contacts on at least two sides from neighboring contacts.

In accordance with at least one alternative embodiment of the present invention, the plurality of contacts comprises a plurality of interior and exterior contacts, where the interior contacts are electrically shielded on four sides from neighboring contacts. A pair of first and second shield members shields each of the interior contacts from neighboring contacts. The first shield members are made of an electrically conductive material and comprise a single unit extending along at least two adjacent rows of contacts removably engaging a mating electrical connector. Each of the second shield members mechanically engages at least one of the first shield members, preferably electrically connecting to at least one of the first shield members.

In accordance with at least one alternative embodiment of the present invention, the second shield member is made of an electrically conductive material and is generally planar in shape. The second shield member has a generally planar main body and at least two resilient arms extending from opposing sides of the main body and adapted to be deflected within a plane of the main body. A portion of each of such main body is adapted to overlap a portion of one or more respective contacts, electrically shielding the contacts from any neighboring contacts.

In yet another embodiment, the first and second shield members are formed of an electrically conductive material selected from a group consisting of sheet metal, copper, nickel, zinc, brass and the like. The first and second shield members, or portions thereof, may be made of the same or different material.

In an alternate embodiment, the second shield members engage at least one of the first shield members. At least one of the second shield members is disposed between two first shield members, the second shield members having a pair of arms that engage the first shield members.

In accordance with yet another alternate embodiment, the housing is made of an insulating material, having front mating and opposing mounting faces. The housing defines a plurality of slots, wherein each of the second shield members is disposed in respective slots.

In accordance with yet another alternative embodiment, each of the contacts has a mating section adapted to engaging mating portions of a mating electrical connector. Each contact includes a pair of resilient beams adapted to engage mating portions of a plurality of contacts in the mating electrical connector. Further, each connector has a mounting section adapted to engage a circuit board.

Yet another alternate embodiment of the present invention includes an electrical connector used with a circuit board for carrying high speed data. In this embodiment, the connector includes a plurality of electrically conductive members in a housing arranged in a grid and means for electrically shielding each of the conductive members from neighboring conductive members on at least two adjacent sides.

In an alternative embodiment, the electrical connector used with a circuit board comprises a plurality of interior and exterior contacts, each of the interior contacts are electrically shielded from neighboring contacts on four sides. The shielding means comprise first shield members disposed in contact rows and second shield members disposed in contact columns in the grid, such that the second shield members engage neighboring first shield members. Each of the interior contacts are shielded from neighboring contacts by a pair of the first shield members and a pair of the second shield members.

Another alternative embodiment in accordance with the present invention includes a method of transmitting high speed data signals through an electrical connector. The electrical connector has engaging first and second shield members. The data signal is transmitted at a predetermined data rate greater than about 2 gigahertz and with a predetermined signal to noise ratio. Data is further transmitted through the connector at a high speed with a predetermined jitter signal to noise ratio.

BRIEF DESCRIPTION OF THE DRAWINGS

The foregoing summary, as well as the following detailed description of the embodiments of the invention, will be better understood when read in conjunction with the appended drawings. For the purpose of illustrating the invention, there is shown in the drawings, embodiments which are present. It should be understood, however, that the present invention is not limited to the precise arrangements and instrumentality shown in the attached drawings.

DETAILED DESCRIPTION OF A PREFERRED EMBODIMENT

Figure 1:
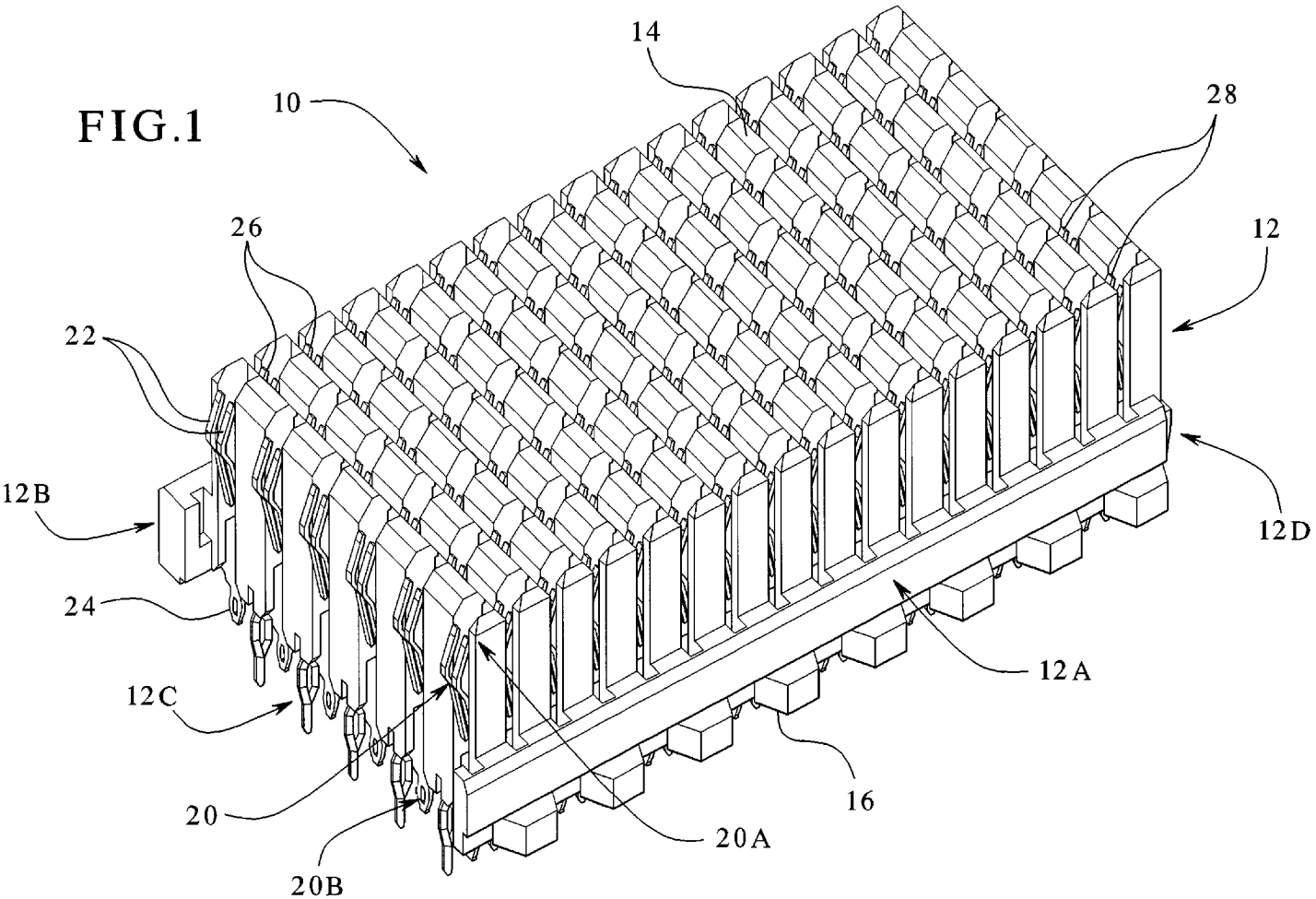
FIG. 1 is top perspective view of one embodiment of an electrical connector according to the present invention.

There is shown in FIG. 1 an electrical connector 10 including housing 12 having opposing sides 12A and 12B, opposing ends 12C and 12D, and a plurality of electrical contacts 20. The housing further has a front mating face 14 and an opposite circuit board mounting face 16. In one preferred embodiment, the housing is made of any suitable insulating material, including, for example, liquid crystal polymer ("LCP").

Each of the contacts 20 has distal and proximal ends 20A and 20B respectively, and a mating section in the form of a pair of resilient beams 22 proximate distal end 20A. The resilient beams are adapted for engagement with mating portions of contacts in a mating electrical connector (not shown), and a circuit board mounting section 24 that is adapted for engagement with a circuit trace on a circuit board (not shown).

The contacts 20 are arranged in a grid of mutually perpendicular linear arrays that may be defined as contact columns 26 and contact rows 28. A pair of adjacent columns 26 and a pair of adjacent rows 28 is indicated by reference numerals in FIG. 1. In the present example there are a total of sixteen contact columns 26 and six contact rows 28. It should be appreciated that the terms columns and rows are arbitrary designations that are assigned to distinguish the linear arrays extending in one direction from the linear arrays extending perpendicular thereto, and that these terms are independent of the orientation of the connector. It should also be appreciated that, while the sixteen contact columns and six contact rows are depicted and discussed, any number of columns and rows are contemplated.

Figure 2:
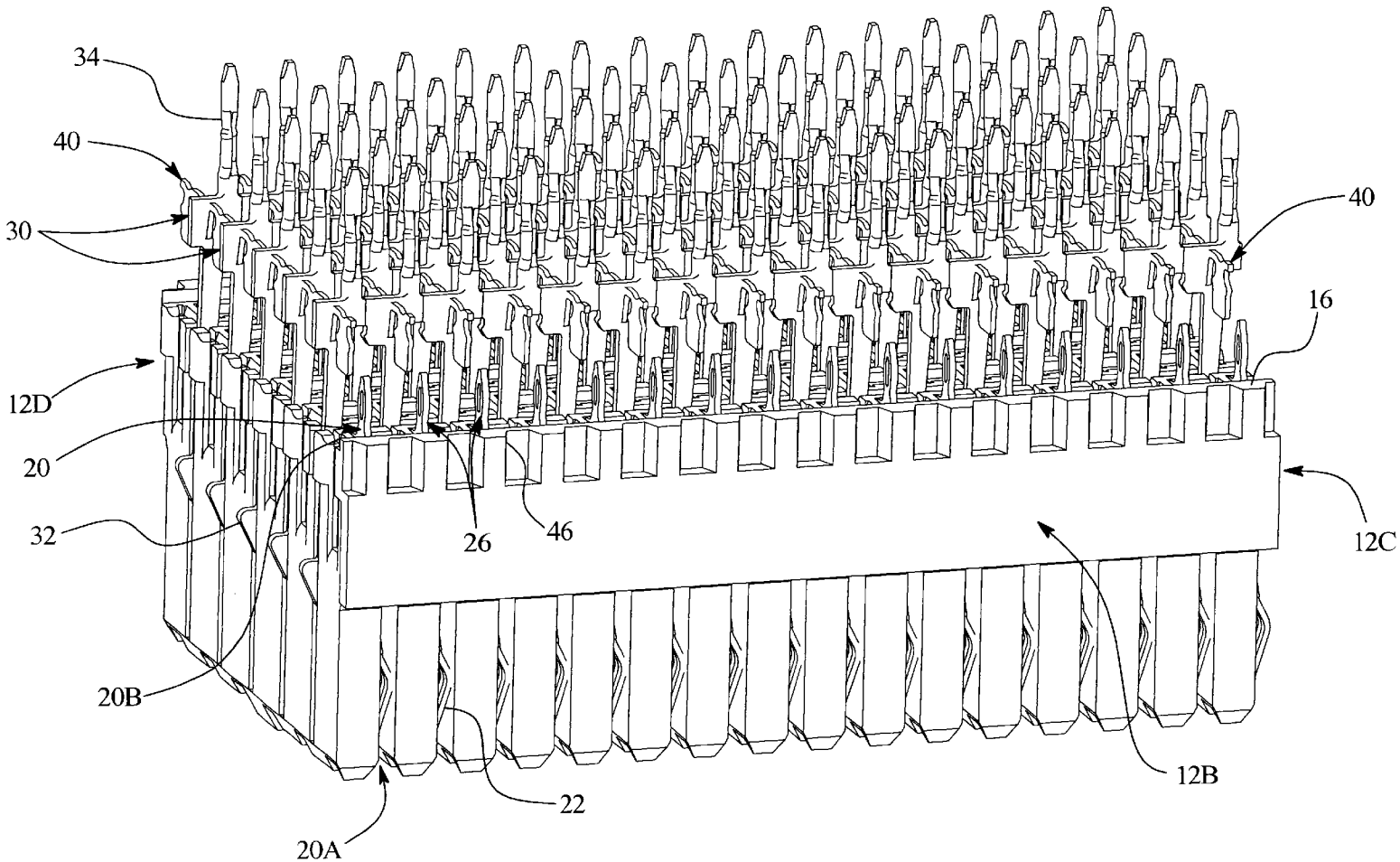
FIG. 2 is bottom perspective view of the electrical connector of FIG. 1 with shield members partially exploded out of the connector.
Figure 3:
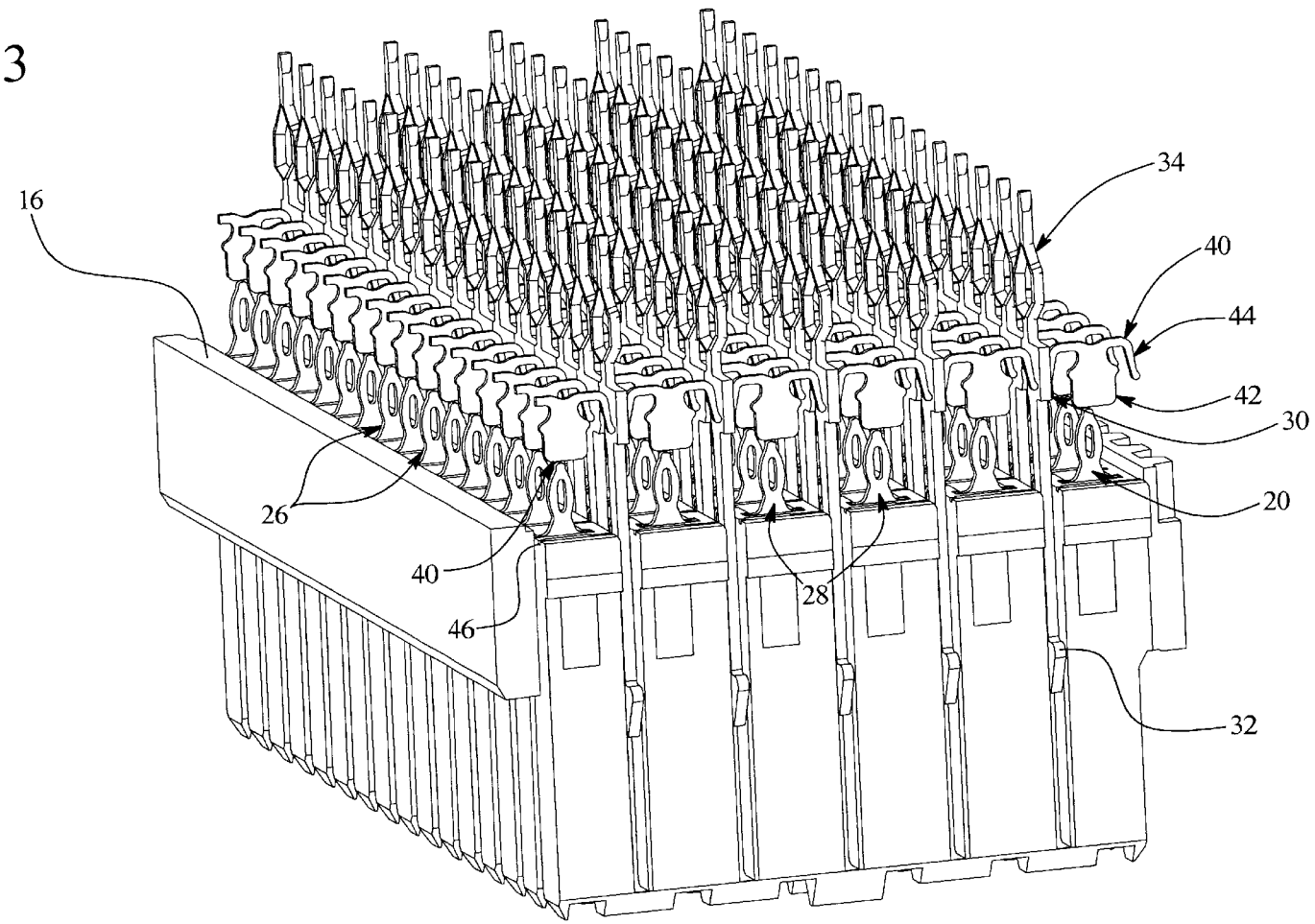
FIG. 3 is bottom perspective view of the electrical connector of FIG. 1 with shield members partially exploded out of the connector.

With reference to the partially exploded views illustrated in FIGS. 2 and 3, first shield members 30 are disposed in the housing 12 between the rows 28 of contacts 20. Each of the first shield members is preferably configured as a one-piece unit that extends entirely along the length of two adjacent rows 28 of contacts. The first shield members 30 have mating sections 32 that are adapted for engagement with ground contacts of a mating electrical connector (not shown), and board mounting sections 34 that are adapted for engagement with electrical ground paths on a circuit board (not shown).

Each of the first shield members 30 is comprised of an electrically conductive material. In one preferred embodiment, the first shield members are stamped from sheet material. However, other materials, including but not limited to copper, nickel, zinc, brass and any combinations, derivatives and alloys thereof are contemplated. Furthermore other methods of forming the first shield members are contemplated, including forming portions of the first shield members as separate pieces and then joining the separate pieces to form an integral conductive unit.

Figure 4:
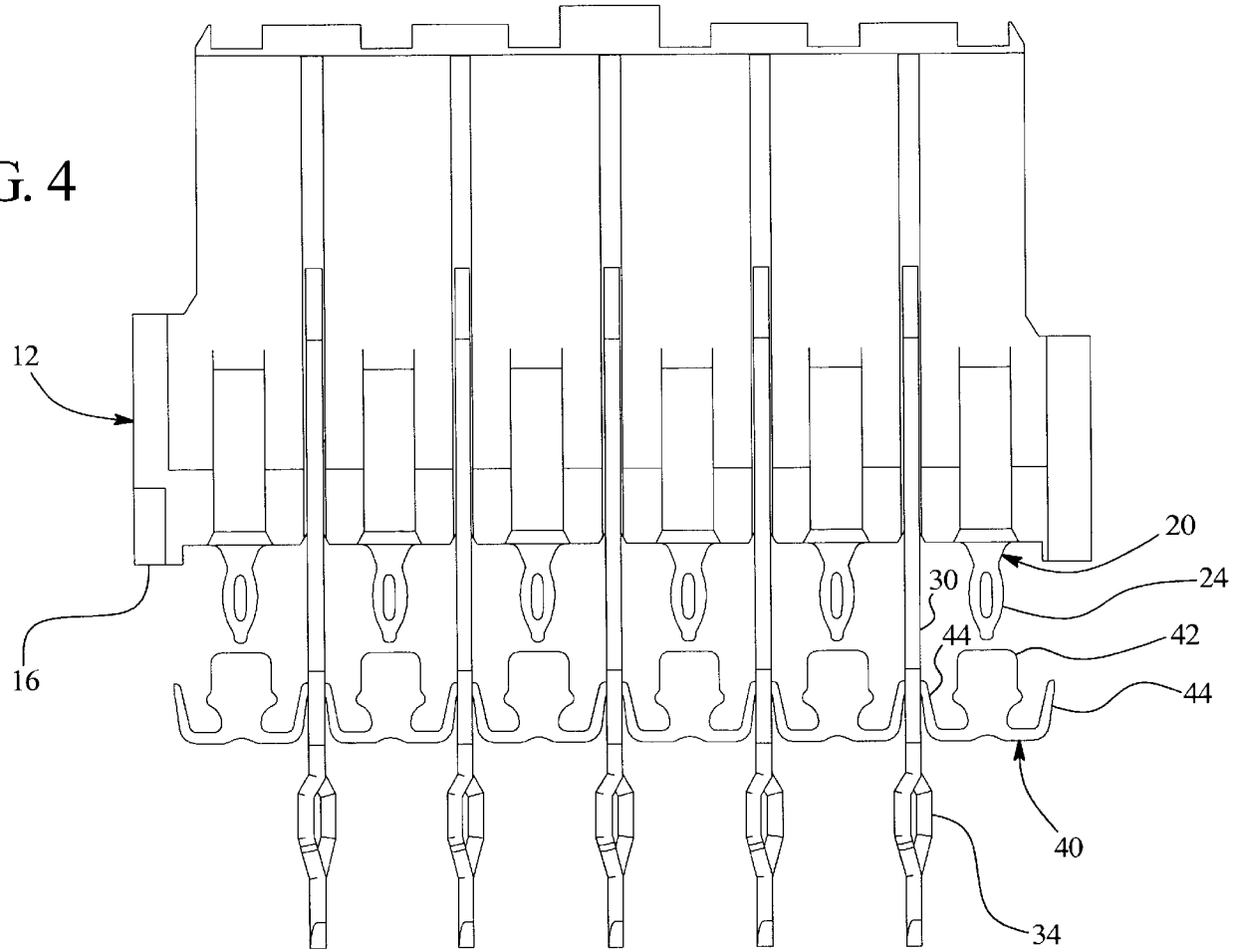
FIG. 4 is a partial side view of the electrical connector of FIG. 1 illustrating the shield members partially exploded out of the connector.

With reference also to FIG. 4, second shield members 40 are disposed into the housing 12 between the columns 26 of contacts 20. Preferably, each of the second shield members 40 mechanically engages and electrically connects with at least one of the first shield members 30.

Figure 5:
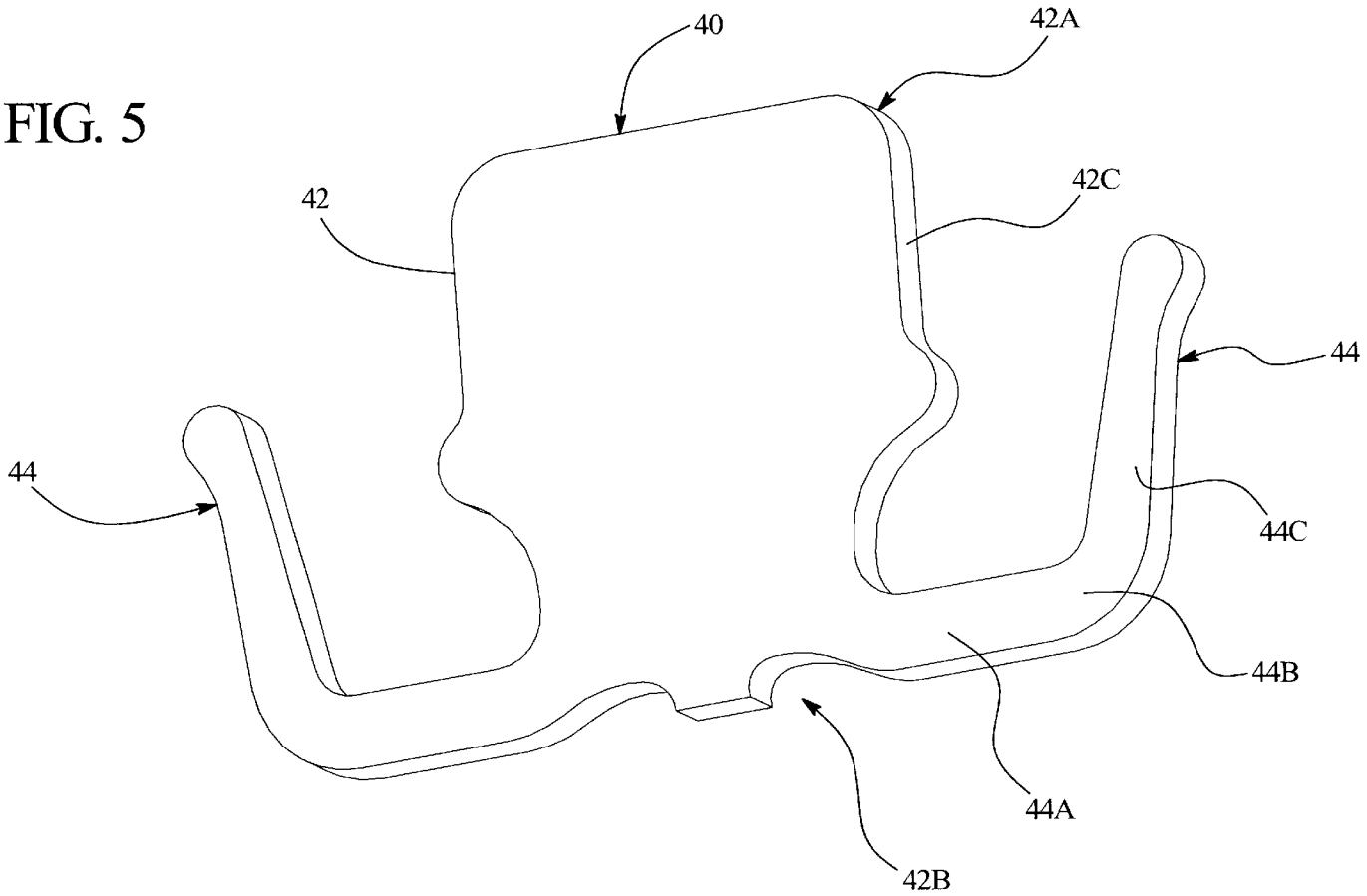
FIG. 5 is an side perspective view of one of the shield members used with the electrical connector of FIG. 1.

One embodiment of the second shield members 40 is illustrated in FIG. 5. The second shield member has a planar body including a plate-like main body section 42 having an engaging portion 42A and a connecting portion 42B. At least one but preferably a pair of resilient arms 44 are integrally connected to and extend from opposite sides 42C of the main body proximate the connecting portion 42B. It should be appreciated that while only a pair of arms 44 are illustrated, any number of arms is contemplated. By way of example, two arms could extend from opposing sides, while two arms could extend from opposing surfaces of the main body.

Each arm has first portion 44A that integrally connects to and extends outwardly from the main body section proximate connecting portion 42B. A second curved portion 44B connects to first portion 44A and a third elongated portion 44C. Third elongated portion extends away from the main body section so that the resilient arms have a "wing like" appearance when viewed from the side. The second shield member has an overall "w-like" shape when viewed from the side (best viewed in FIG. 5).

Each second shield member is preferably formed as a single piece from an electrically conductive material. In one preferred embodiment, the second shield member is stamped from sheet metal as a single unit, although other conductive materials, including but not limited to copper, nickel, zinc, brass and any combinations, derivatives and alloys thereof are contemplated.

As with the first shield member, preferably the second shield members are stamped from one piece of an electrically conductive material. However other methods of forming the second shield members are contemplated, including forming the main body section and the arms as separate pieces and then joining the separate pieces together to form an integral conductive unit. Furthermore, it is contemplated that the pieces could be formed of different materials. By way of example only, the main body portion could be formed of sheet metal and one or more arms formed of copper.

Preferably, the first and second shield members are comprised of the same material. However, alternate embodiments are contemplated in which the first and second shield members are comprised of a different material. By way of example only, the first shield members could be comprised of sheet metal while the second shield members could be comprised of nickel.

The resilient arms 44 are adapted to be deflected within the plane of the second shield member. This deflection enables the arms 44, and thus the main body section 42, to accommodate different manufacturing tolerances, specifically tolerances related to the housing, contacts and/or the first and second shield members. This deflection ensures good mechanical and electrical contact between the first and second shield members.

The main body section 42 has an area that is configured to overlap a portion of a side face 20C of each contact 20, thereby electrically shielding the contact along its side face.

Referring again to FIGS. 2–4, the second shield members 40 are disposed in respective slots 46 in the housing 12. Each of the second shield members has at least one resilient arm 44 in engagement with one of the first shield members 30. The second shield members 40 that are disposed between pairs of adjacent first shield members 30 have both of their resilient arms 44 engaged with the flanking first shield members.

Figure 6:
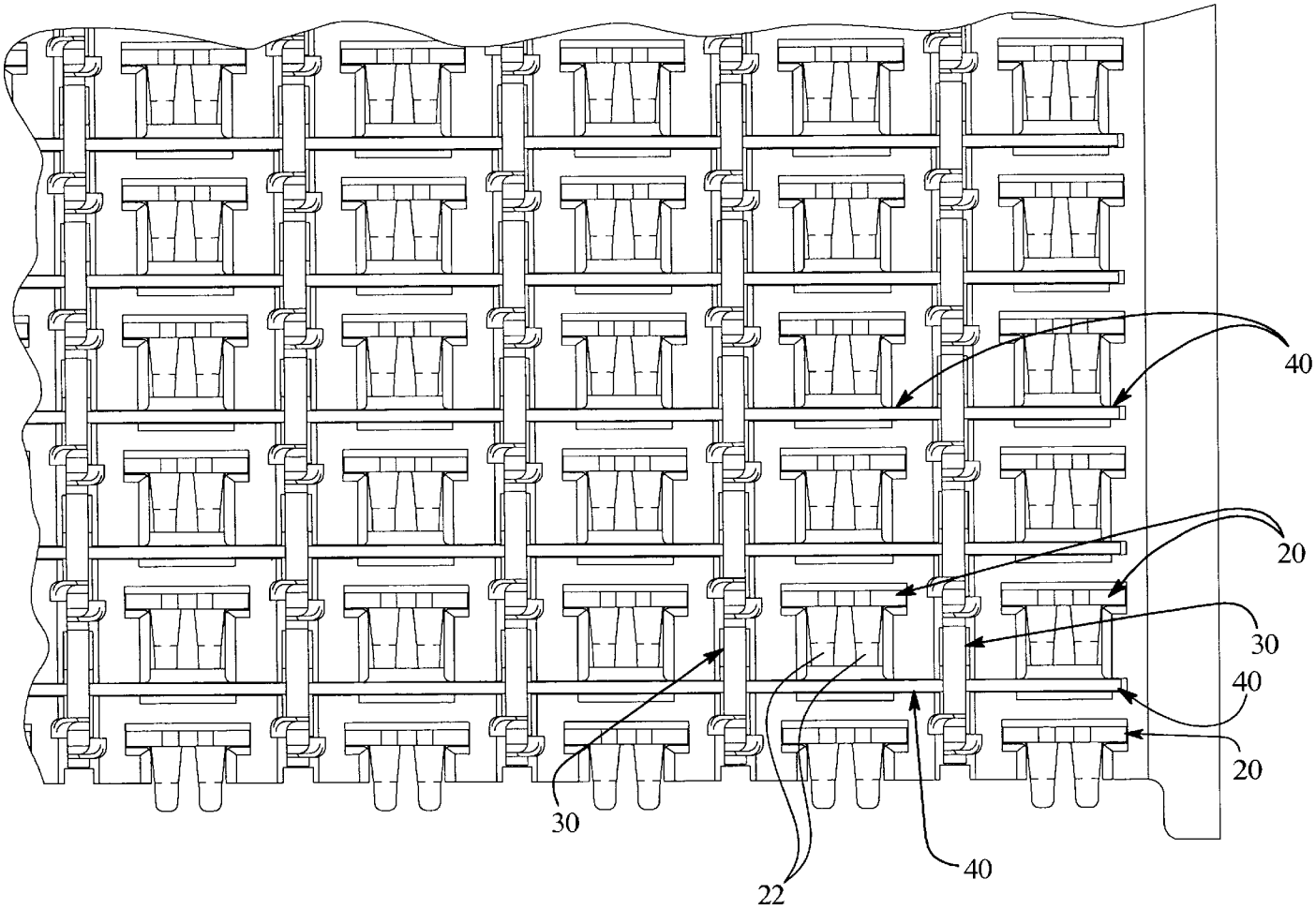
FIG. 6 is a bottom plan view of the electrical connector of FIG. 1.

As shown in FIG. 6, the contacts 20 that are in rows and columns at the exterior portion of the contact grid are flanked on either two or three sides by a combination of the first shield members 30 and the second shield members 40. More significantly, each of the contacts in the interior of the contact grid is flanked on two sides by a pair of the first shield members 30, and on two other sides by a pair of the second shield members 40. These pairs of first and second shield members are mechanically engaged with and electrically connected to each other, thereby providing a shielding ring that surrounds each of the interior contacts 20. Thus, each of the contacts in an interior portion are isolated on four sides from its neighboring contacts by a shielding ring that extends 360° around each contact.

In accordance with at least one embodiment of the present invention, an electrical connector or connector assembly is provided that supports a method of transmitting high speed data signals in a carrier wave through a connector with desired signal performance characteristics that may be expressed in terms of the amplitude signal-to-noise ratio. The high speed data signal carries data at a predetermined data rate and having a predetermined amplitude. In one preferred embodiment, the high speed data is transmitted at greater than or equal to about 2 gigahertz. In another preferred embodiment, the high speed data signal is transmitted through the connector at about 5 or 10 gigahertz.

A transmission method is provided in which the transmitted data signal maintains an amplitude signal-to-noise ratio that does not substantially exceed a predetermined outer limit. By way of example only, the amplitude of the noise should not substantially exceed 25% of the amplitude of the data signal. Preferably, the high speed data signal is transmitted in accordance with at least one embodiment of the present invention while maintaining an amplitude signal-to-noise ratio that does not substantially exceed the predetermined outer limit.

In accordance with an alternative embodiment of the present invention, an electrical connector is provided that supports a method of transmitting a high speed data signal in a carrier wave through a connector and having a desired jitter signal performance characteristic that may be expressed in terms of the jitter signal-to-noise ratio (jitter SNR). High speed data signals are transmitted having a predetermined variation in arrival time between adjacent discrete data signals. By way of example only a high speed data signal is transmitted maintaining a variation between adjacent discrete data signals that is no greater than an outer limit of 12.5% jitter SNR.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features that which come within the spirit and scope of the invention.

What is claimed is:

1. An electrical connector, comprising:

a housing having a plurality of contacts arranged in contact rows and columns;

first shield members disposed in said housing between said contact rows; and second shield members disposed in said housing between said contact columns, wherein said second shield members engage neighboring ones of said first shield members, each of said second shield members having at least two resilient arms extending from opposing sides of said main body and adapted to be deflected within a plane of said main body.

2. The electrical connector of claim 1, wherein said first and second shield members electrically shield each of said contacts on at least two sides.

3. The electrical connector of claim 1, wherein said plurality of contacts includes a plurality of interior and exterior contacts.

4. The electrical connector of claim 3, wherein each of said interior contacts is electrically shielded on four sides.

5. The electrical connector of claim 3, wherein each of said interior contacts is shielded from neighboring contacts by a pair of said first shield members and a pair of said the second shield members.

6. The electrical connector of claim 1, wherein said first shield members are comprised of an electrically conductive material.

7. The electrical connector of claim 1, wherein each of said first shield members comprises a single unit adapted to extend along at least two adjacent rows of contacts.

8. The electrical connector of claim 1, wherein said first shield members are adapted to removably engage a mating electrical connector.

9. The electrical connector of claim 1, wherein each of said second shield members mechanically engages at least one of said first shield members.

10. The electrical connector of claim 1, wherein each of said second shield members is adapted to electrically connect to at least one of said first shield members.

11. The electrical connector of claim 1, wherein said second shield member is generally planar in shape.

12. The electrical connector of claim 1, wherein each of said second shield members has a generally planar main body.

13. The electrical connector of claim 12, wherein each of said second shield members has at least one arm extending from said main body.

14. The electrical connector of claim 1, wherein said arms and said main body are formed of a same material.

15. The electrical connector of claim 1, wherein said arms and said main body are formed of a different material.

16. The electrical connector of claim 12, wherein a portion of each said main body is adapted to overlap a portion of at least one contact, thereby electrically shielding said contact.

17. The electrical connector of claim 1, wherein each of said second shield members engages at least one of said first shield members.

18. The electrical connector of claim 1, wherein at least one of said second shield members is disposed between two first shield members, said second shield members having a pair of arms adapted to engage said first shield members.

19. The electrical connector of claim 1, wherein said first and second shield members are made of a same material.

20. The electrical connector of claim 1, wherein said first and second shield members are made of a different material.

21. The electrical connector of claim 1, wherein said housing defines a plurality of slots, and wherein each of said second shield members is disposed in respective slots.

22. The electrical connector of claim 1, wherein said housing is comprised of an insulating material and having front mating and opposing mounting faces.

23. The electrical connector of claim 1, wherein each of said contacts includes a mating section adapted for engaging mating portions of a mating electrical connector.

24. The electrical connector of claim 1, wherein each of said contacts includes a pair of resilient beams adapted to engage mating portions of a plurality of contacts in a mating electrical connector.

25. The electrical connector of claim 1, wherein each of said contacts includes a mounting section adapted to engage a circuit board.

26. The electrical connector of claim 1, wherein said contacts are arranged in a grid of mutually perpendicular linear arrays.

27. An electrical connector for use with a circuit board for carrying high speed data, comprising:

a plurality of electrically conductive members in a housing and arranged in a grid; and means for electrically shielding each of said plurality of conductive members from neighboring conductive members on at least two adjacent sides of said conductive members, said shielding means comprises first shield members disposed in contact rows in said grid and second shield members disposed in contact columns in said grid, wherein said second shield members engage neighboring ones of said first shield members, each of said second shield member having at least two resilient arms extending from opposing sides of a main body and adapted to deflect within a plane of said main body.

28. The electrical connector of claim 27, wherein said shielding means electrically shields at least one of said conductive members on four sides from neighboring conductive members.

29. The electrical connector of claim 27, wherein said conductive members comprises a plurality of interior and exterior contacts, each of said interior contacts electrically shielded from neighboring contacts on four sides.

30. The electrical connector of claim 27, wherein said conductive members include a plurality of interior and exterior contacts, each of said interior contacts shielded from neighboring contacts by a pair of said first shield members and a pair of said second shield members.

31. The electrical connector of claim 27, wherein each of said first shield members comprises a single unit adapted to extend along at least two adjacent contact rows.

32. The electrical connector of claim 27, wherein each of said second shield members mechanically engages at least one of said first shield members.

33. The electrical connector of claim 27, wherein each of said second shield members is adapted to electrically connect to at least one of said first shield members.

34. The electrical connector of claim 27, wherein each of said second shield members is generally planar in shape.

35. The electrical connector of claim 27, wherein each of said second shield members has a generally planar main body.

36. The electrical connector of claim 27, wherein each of said second shield member has at least one arm extending from a main body.

37. The electrical connector of claim 27, wherein a portion of each said main body is adapted to overlap a portion of respective conductive members.

38. The electrical connector of claim 27, wherein at least one of said second shield members is disposed between two first shield members, said second shield members having a pair of arms adapted to engage said first shield members.

39. The electrical connector of claim 27, wherein each of said conductive members includes a mating section adapted for engaging mating portions of a mating electrical connector.

40. The electrical connector of claim 27, wherein each of said conductive members includes a mounting section adapted to engage the circuit board.

41. A circuit board for use with high speed data, comprising:

a circuit trace; and a connector adapted to engage said circuit trace, wherein said connector includes a housing having a plurality of contacts arranged in contact rows and columns, first shield members disposed in said housing between said contact rows and second shield members disposed in said housing between said contact columns, wherein said second shield members engage neighboring ones of said first shield members, said second shield members including a main body and at least one resilient arm extending from said main body and adapted to be deflected within a plane of said main body.

* * * * *